US008464777B2

(12) United States Patent
Zhu et al.

(10) Patent No.: US 8,464,777 B2
(45) Date of Patent: Jun. 18, 2013

(54) METHOD AND APPARATUS FOR MANUFACTURING TURBINE OR COMPRESSOR WHEELS

(75) Inventors: Qiang Zhu, Sheffield (GB); Andrew Phillip Jackson, Wakefield (GB)

(73) Assignee: Cummins Turbo Technologies Limited, Huddersfield (GB)

( * ) Notice: Subject to any disclaimer, the term of this patent is extended or adjusted under 35 U.S.C. 154(b) by 427 days.

(21) Appl. No.: 11/989,271

(22) PCT Filed: Jun. 29, 2006

(86) PCT No.: PCT/GB2006/002378

§ 371 (c)(1),
(2), (4) Date: Jan. 22, 2008

(87) PCT Pub. No.: WO2007/010181

PCT Pub. Date: Jan. 25, 2007

(65) Prior Publication Data

US 2009/0160091 A1 Jun. 25, 2009

(30) Foreign Application Priority Data

Jul. 19, 2005 (GB) ..... 0514751.7

(51) Int. Cl.
*B22D 17/00* (2006.01)
*B22D 33/04* (2006.01)

(52) U.S. Cl.
USPC ..... 164/113; 164/137; 164/342

(58) Field of Classification Search
USPC ..... 165/113, 137, 312, 342; 164/113, 164/137, 312, 342
See application file for complete search history.

(56) References Cited

U.S. PATENT DOCUMENTS

| | | | | |
|---|---|---|---|---|
| 3,948,650 | A | 4/1976 | Flemings et al. | |
| 4,059,143 | A * | 11/1977 | Morita et al. | 164/113 |
| 4,284,124 | A * | 8/1981 | Komatsu et al. | 164/314 |
| 4,294,303 | A * | 10/1981 | Flesburg | 164/44 |
| 4,337,817 | A | 7/1982 | Komatsu et al. | |
| 5,124,105 | A * | 6/1992 | Broughton et al. | 264/219 |
| 5,174,357 | A * | 12/1992 | Allen | 164/340 |

(Continued)

FOREIGN PATENT DOCUMENTS

| | | |
|---|---|---|
| EP | 0 728 545 A2 | 8/1996 |
| EP | 0980730 A1 | 2/2000 |

(Continued)

OTHER PUBLICATIONS

International Search Report, PCT/GB2006/002378, Cummins Turbo Technologies Limited, Jun. 12, 2007, International Searching Authority/European Patent Office.

(Continued)

*Primary Examiner* — Kevin P Kerns
(74) *Attorney, Agent, or Firm* — Kreig DeVault LLP; Clifford W. Browning

(57) ABSTRACT

A method for forming a turbine or compressor wheel from a semi-solid material uses a die assembly that has an inner cartridge made up from a plurality of segments and an outer die. The semi-solid material is injected under pressure and high temperature into the die so that it flows into blade cavities defined between the segments of the cartridge. The cartridge is removed from the outer die and the segments are then separated to release the wheel.

52 Claims, 8 Drawing Sheets

U.S. PATENT DOCUMENTS

| | | | | |
|---|---|---|---|---|
| 5,630,466 | A | 5/1997 | Garat et al. | |
| 5,730,201 | A * | 3/1998 | Rollin et al. | 164/113 |
| 5,832,982 | A | 11/1998 | Williams et al. | |
| 5,879,478 | A | 3/1999 | Loue et al. | |
| 6,214,478 | B1 | 4/2001 | Soeli et al. | |
| 2003/0205351 | A1 | 11/2003 | Buckley | |
| 2005/0014453 | A1 | 1/2005 | Mayer et al. | |
| 2006/0090870 | A1 * | 5/2006 | Hashimian et al. | 164/35 |

FOREIGN PATENT DOCUMENTS

| | | | |
|---|---|---|---|
| FR | 2141979 | | 1/1973 |
| FR | 2788788 | | 7/2000 |
| GB | 2 026 363 | | 2/1980 |
| JP | 58070961 | A | 4/1983 |
| JP | 59232810 | A | 12/1984 |
| JP | 62117717 | A | 5/1987 |
| JP | 63171242 | A | 7/1988 |
| JP | 03013251 | A | 1/1991 |
| JP | 06007883 | A | 1/1994 |
| JP | 10216917 | A | 8/1998 |
| JP | 2003340558 | A | 12/2003 |
| SU | 1076183 | A | 2/1984 |
| WO | WO 00/53914 | | 9/2000 |
| WO | WO 2005/014869 | | 2/2005 |

OTHER PUBLICATIONS

R. Das Gupta, "Industrial Applications—The Present Status and Challenges We Face", in Proceedings of the 8th International Conference on Semi-Solid Processing of Alloys and Composites, Limassol, Cyprus, Sep. 21-23, 2004.

Written Opinion, PCT/GB2006/002378, Jun. 21, 2007 Cummins Turbo Technologies Limited.

Search Report, GB0514751.7, Dec. 7, 2005, Cummins Turbo Technologies Limited.

Search Report, GB0514751.7, May 2, 2006, Cummins Turbo Technologies Limited.

* cited by examiner

METHOD AND APPARATUS FOR MANUFACTURING TURBINE OR COMPRESSOR WHEELS

The present application is a 35 U.S.C. §371 filinq from PCT/GB2006/002378 filed on Jun. 29, 2006. which claims priority to United Kingdom Patent Application No. GB0514751.7 filed Jul. 19, 2005. Each of the above-referenced applications are incorporated herein by reference.

The present invention relates to the manufacture of turbine and compressor wheels and particularly, but not exclusively, the manufacture of such wheels for use in a turbocharger.

BACKGROUND

Turbochargers are well known devices for supplying air to the intake of an internal combustion engine at pressures above atmospheric (boost pressures). A conventional turbocharger essentially comprises an exhaust gas driven turbine wheel mounted on a rotatable shaft within a turbine housing. Rotation of the turbine wheel rotates a compressor wheel mounted on the other end of the shaft within a compressor housing. The compressor wheel delivers compressed air to the engine intake manifold.

Compressor and turbine wheels have very complex shapes in order to change the direction and speed of flow of the air/exhaust gases and the pressure thereof. The wheels comprise thin-walled blade sections of around 1 mm thickness that are attached at an angle of between 45° and 90° to a large section hub. The air or gas flows along passages defined between the blades and the housing. For example, in a compressor wheel the blades are initially shaped to draw in the intake air in a generally axial direction and are then curved outwardly to redirect the air to flow in a radial direction whilst at the same time applying a centrifugal force and accelerating the air to a high velocity. The air must then be projected at high pressure by the blade tips into an outlet volute chamber at the radial periphery of the wheel. The form of the blades is fundamental to the aerodynamic performance of the turbocharger wheels and has to be accurately specified and repeated on each blade. In addition to the complex profile of the blades, the wheel has undercuts and other sudden changes in surface contours. The complexities of shape in the wheels ensures that all of the current manufacturing methods such as, for example, casting or machining from forgings, have their own unavoidable disadvantages.

The most common method for producing turbocharger wheels at the present time is casting. This is a relatively low cost process that can produce accurately dimensioned products. In the method, liquid metals, for example, Ni base superalloys for turbine wheels and Al—Si alloys for compressor wheels, are poured into a ceramic or plaster mould that has previously been produced by forming it over a master pattern such as wax, the wax being removed by a suitable solvent or by heating prior to the alloy being poured into the mould. Once the metal has cooled to room temperature the ceramic or plaster is broken away to reveal the wheel. The initial wax pattern is usually produced by injecting molten wax into a die.

Aluminium, being of low weight and relatively low cost, is a preferred material in the manufacture of both compressor and turbine wheels. In the former case it is used in the form of a matrix and in the latter it is used as an alloying element for turbine wheels. One disadvantage associated with aluminium is that it is prone to oxide defects both before and during casting even in a vacuum or inert gas environment. This kind of defect is not easily controllable and it reduces the durability of the component dramatically as it is generally where fatigue failure is initiated. The durability of such wheels is consequently difficult to predict and, as a result, turbochargers are less reliable. Major efforts have been made in recent years to reduce the oxide effects in casting aluminium and nickel base superalloy wheels but to little or no avail.

A further difficulty associated with casting of turbocharger wheels lies in the control of the microstructure of the material. The complex shape of the wheel means that it is almost impossible to ensure consistent control of the shrinkage, gas porosity and homogeneity of microstructure in terms of grain size, dendrite size and second phase particle size and so the consistency of component quality is reduced.

To address the problems associated with casting, a recent development has been to cast the material into a billet, extrude it into a bar, cut the bar into pieces, forge those pieces and then machine each forged piece into the shape of the wheel by a multi-axis machine. In this process any defects such as oxide inclusions and porosity are removed during the extrusion, forging and machining operations. Also, fine and homogenous grain structure and second phase particles can be obtained. The consistency in the durability of wheels made in accordance with this process is much improved in comparison to those produced by conventional casting. Although the process affords repeatable production of durable wheels it is, in view of the number of stages, labour intensive and much higher in cost compared to the casting method.

Whilst it is desirable to have a manufacturing process that can repeatedly produce high quality turbocharger wheels there is a need to ensure that the process is at reasonable cost.

It is well known that semi-solid forming of metals can be used to produce products of high strength and ductility without shrinkage problems. Semi-solid forming is a term used to describe the processing of a metal alloy that is between its liquidus and solidus temperatures where it comprises a slurry of solid phase metal particles suspended in the liquid phase molten metal. The dendritic solid particles are modified (e.g. by agitation) so that they approximate to spheroids. The most popular methods of processing: thixocasting and rheocasting of metals are known to produce components at low cost and of a quality comparable to components machined from solid metals. In thixocasting, the semi-solid thixotropic billet is produced by cooling the slurry whilst the dendritic microstructure is modified until it is solid and then reheating it to the semi-solid state, where the billet contains about 30-70% liquid phase, immediately before injection or casting into a mould. In rheocasting the alloy is fully melted, then cooled to a temperature between liquidus and solidus where solid particles are surrounded by liquid eutectics, the microstructure is modified and the component is formed by injection or casting the material in its semi-solid state into a mould. Rheocasting is attractive in that it offers the possibility of providing a semi-solid material on demand ready for injection into a mould in contrast to thixocasting where material is effectively provided in batches of solid billets for reheating before injection.

In both cases the semi-solid material can be transferred into a high-pressure injection or die-casting machine and injected into a die. After the injected material solidifies, the die is removed from the machine and is opened to expose the designed part. The advantage of thixocasting is that the desired homogeneous microstructure and elimination of casting defects is more controllable, but a disadvantage is that it is of higher cost than rheocasting.

The process of semi-solid forming has heretofore not been considered for the manufacture of complex shapes such as turbocharger wheels. All the current applications of semi-solid processing are for the production of relatively simple shapes where there are no large variations is cross-sectional area or complex profiles such as those described above. Examples of such manufacturing methods are described in U.S. Pat. Nos. 5,630,466, 6,214,478, US patent application no. 2003205351 and European patent no. 0980730.

The thixotropic behaviour of metal alloys at a semi-solid state and application of the thixotropic behaviour to shape metal products has been the subject of significant research. The production of thixoformable alloys and producing simple manufacturing components using thixocasting and rheocasting are described in many patents such as, for example, U.S. Pat. No. 3,948,650, French patent 2141979, U.S. Pat. No. 5,630,466, SK10002001, U.S. Pat. No. 6,214,478 (which specifically describes the production of relatively simple thin-walled body parts for vehicles), U.S. Pat. No. 5,879,478, WO0053914, and EP0980730).

Most early research concentrated on aluminium-silicon alloys as the alloys have a relatively clear boundary of solidification sequence between aluminium particles and silicon eutectics. For instance, the most popular thixoformable aluminium alloys A356 (6.5-7.5% Si, <1% of each other elements) and its modification alloy A357, (adding about 0.03% Sr and increasing Mg content to increase strength) were widely applied to manufacturing automotive components. The most popular components can be summarised as (see R. DasGupta: Industrial Applications—The Present Status and Challenges We Face in the Proceedings of the 8$^{th}$ International Conference on Semi-Solid Processing of Alloys and Composites, Limassol, Cyprus, 21-23 Sep. 2004):

(1) Fuel rail manufactured by Thixocasting of alloy A357;
(2) Automatic transmission gear shift lever manufactured by Thixocasting of alloy A357;
(3) Engine mount manufactured by Rheocasting of alloy A357;
(4) Different types of engine bracket manufactured by Rheocasting of alloy A357;
(5) Upper control arm manufactured by Rheocasting of alloy A356;
(6) Suspension manufactured by Rheocasting of alloy A357; and
(7) Diesel engine pump body manufactured by Rheocasting of alloy A356

The products made by this process have been given significant quality improvement over castings and cost benefit over machined from solid metals.

A general feature of all the products described above is the relatively simple shape: the ratio of thinnest part of the product to its thickest section is no greater than about 1:2, and a simple casting die can be used to manufacture the product. Moreover, the components mentioned above are designed for operation in relatively simple conditions and often benign environments, unlike turbocharger wheels, which work under very complex conditions caused by thermal cycles, speed cycles and gas pressure etc.

There are more than ten different methods to shaping thixotropic alloys. All use the same concept, i.e. obtaining semi-solid microstructure with spheroidal solid particles surrounded by liquid phase and then to form the semi-solid material.

It is an object of the present invention to obviate or mitigate the above and other disadvantages and to provide for a method and apparatus for manufacturing the complex shapes of compressor and turbine wheels for turbochargers using a semi-solid process.

SUMMARY

According to a first aspect of the present invention there is provided a method for forming a turbine or compressor wheel, the wheel having a hub and a plurality of blades of complex curvature extending outwardly from the hub, using a die assembly comprising an outer die and an inner die cartridge assembly, the method comprising the steps of assembling the inner die cartridge assembly from a plurality of die segments so that the cartridge assembly defines a central hub cavity and a plurality of blade cavities extending outwardly from the hub cavity, said blade cavities being defined between adjacent die segments, inserting the cartridge assembly into the outer die, injecting a semi-solid metal alloy into the die so that it flows into the cartridge assembly and the blade cavities, maintaining temperature and pressure within the cartridge assembly within predetermined ranges during the injection stage, removing the cartridge assembly from the outer die and separating the die segments of the cartridge assembly to release the formed wheel.

The cost is comparable with castings and the quality is comparable to components machined from forgings.

This aim is achieved by careful selection of alloy systems, component design, design of tooling, optimisation of processing parameters and post surface treatment.

The die segments may be assembled to define a cartridge assembly that is annular.

The cartridge assembly preferably further comprises a cover, the hub cavity being defined between an outer surface of the die segments and the cover. The assembled die segments are ideally placed inside an outer ring of the cartridge assembly and the cover may be assembled with the die segments before insertion of the cartridge assembly into the outer die. The cover may be secured to the outer cartridge ring.

The alloy is preferably injected through an opening in the cartridge assembly into the hub cavity. The semi-solid alloy may be injected such that it first enters the hub cavity and then progresses into the blade cavities. Alternatively a pre-formed hub may be inserted into the hub cavity of the inner die cartridge prior to the injection stage so that the blades are formed with the semi-solid material on the pre-formed hub. In this way the blades can be formed easily on to a hub that is machined from stock, cast or forged etc.

In the case where the hub is not pre-formed the semi-solid alloy passes from the hub cavity into the blade cavities via slot-like openings.

Preferably the cartridge assembly is reassembled for re-use after the formed wheel has been released. In one embodiment of the invention there is provided a second inner die cartridge that is pre-assembled and inserted into the die after removal of the first inner die cartridge. Any number of pre-assembled cartridges can be provided to make the manufacturing operation more expedient. The, or each, die cartridge can be pre-heated to a pre-determined temperature before injection and indeed can be pre-heated to a predetermined temperature prior to insertion into the outer die.

The semi-solid material is produced by heating up thixotropic billets or casting from liquid metals into semi-solid state by special technologies.

The cartridge is preferably cooled prior to disassembly.

The die segments, at least, may be treated with a release agent prior to injection. The release agent serving to facilitate removal of the die segments from the formed wheel after the cartridge has been removed from the die assembly.

In one preferred embodiment after a predetermined period following injection of the alloy, the cartridge assembly is removed from the rest of the die assembly and the segments are separated to expose the blades of the wheel.

The die assembly may further comprise first and second parts that define a chamber in which the cartridge is received. The cartridge is preferably placed in the chamber and then first and second parts of the die are brought into sealing engagement. The chamber is preferably defined in the first part of the die assembly.

The alloy may be injected via a runner passage in a runner block on the first part of the die, the passage providing communication between an injection device and the die hub cavity, the runner block being moved to a first position after insertion of the cartridge so that it is positioned over the chamber and the cartridge, and is moved to a second position in which it is clear of the chamber and the cartridge after the injection step is complete so as to allow removal of the cartridge. The runner block may have first and second portions that are brought together in the first position to define the runner passage and are moved apart to the second position. The first and second portions may be slid relative to the first part of the die by an actuator. The method may include the step of stripping oxides from the surface of the alloy during its travel through the runner passage and a stepped reduction in size of the runner passage may be used for this purpose.

The runner passage may have a first portion that extending from an inlet to the runner block and a second portion that extends from adjacent to the die hub cavity, the first and second portions intersecting, the first portion having a blind end after the intersection, the volume between the intersection and the blind end serving to receive an initial portion of the injected alloy so as to serve as an oxide trap. The runner passage is preferably brought into register with an opening in the cartridge cover when the runner block is in the first position. Locating members defined on the die parts may be used to align the first and second parts of the die when they are brought together.

In one preferred embodiment heated oil may be introduced into bores in the die parts to maintain the temperature of the cartridge.

The temperature is preferably maintained in the range 0.6 (liquidus temperature)+/−90K. This may be, for instance for compressor wheels, in the range 200° C. to 350° C. The pressure may be maintained in the range 550 to 2800 bar, or in the range 550 to 1050 bar.

Ideally, the alloy is injected in 40 to 60% solid phase.

The alloy may be injected from a shot sleeve of an injection machine and may be injected within 10 seconds or less.

Once injected into the inner die cartridge, the material is preferably allowed to cool for a predetermined time such that it reaches substantially 100% solid phase before the cartridge is removed from the outer die. The cartridge may be cooled with the pressure of the material being maintained substantially constant.

The alloy may be an aluminium alloy that also comprises copper, silicon and magnesium and/or other alloying elements.

The method may include the steps of forming a blank of thixotropic semi-solid material, reheating the thixotropic material to a semi-solid state in order to achieve a predetermined viscosity suitable for forming and transferring the reheated blank to a die casting injection machine for forming the wheel.

According to a second aspect of the present invention there is provided a die assembly for formation of a compressor or turbine wheel from a semi-solid material, the assembly comprising a cartridge comprising a plurality of die segments, a cover and an outer cartridge ring in which the die segments are received and supported against radially outward movement, a central hub cavity defined between the cover and the segments and a plurality of blade cavities extending outwardly from the hub cavity, said blade cavities being defined between adjacent die segments The die assembly may further comprise an outer die defining a chamber in which the cartridge is removably received.

The cover of the die assembly ideally has an opening that provides communication with the hub cavity. The cover may be secured to the outer cartridge ring.

There may be provided a vent in the die segments and/or outer die to allow gas to escape during introduction of the material into the die.

According to a third aspect of the present invention, there is provided a die assembly for formation of a compressor or turbine wheel from a semi-solid material, the assembly comprising a cartridge comprising a plurality of die segments, a cover, a central hub cavity defined between the cover and the segments and a plurality of blade cavities extending outwardly from the hub cavity, and at least one first vent defined between die segments and in communication with the blade cavity to allow gas in the blade cavity to egress during introduction of the semi-solid material.

The first vent is separate from an inlet by which the semi-solid material is introduced into the die cavities.

The vent is provided at the radial periphery of the blade cavity. The die assembly may further comprise an outer die defining a chamber in which the cartridge is removably received, the outer die having at least one second vent for communication with the first vent.

There may be an outer ring in which the assembled die segments are received, a third vent being provided in said ring and communicating with said first and/or second vents.

According to a fourth aspect of the present invention there is provided a die assembly for formation of a compressor or turbine wheel from a semi-solid material, the assembly comprising a cartridge comprising a plurality of die segments, a cover, a central hub cavity defined between the cover and the segments and a plurality of blade cavities extending outwardly from the hub cavity, wherein there is provided a material inlet and a runner passage, the runner passage providing communication between said inlet and the die hub cavity and being configured to strip an outer layer from the semi-solid material as it passes along passage and before it enters the die cartridge.

The runner passage may be defined by a runner block that has first and second portions that are brought together in the first position to define the runner passage and are movable apart to the second position.

An actuator may be provided and the first and second portions are slidable relative to the first part of the die by said actuator.

The runner passage may have at least one stepped reduction in size in the direction towards the cartridge.

The runner passage may have a first portion that extends from an inlet to the runner block and a second portion that extends from adjacent to the die hub cavity, the first and second portions intersecting, the first portion having a blind end after the intersection, the volume between the intersection and the blind end serving to receive an initial portion of the injected alloy so as to serve as an oxide trap.

The runner passage may be defined in an outer die, the outer die defining a chamber in which the cartridge is removably received.

According to a fifth aspect of the present invention there is provided a turbocharger comprising a compressor or a turbine wheel as defined in any one of the aspects of the invention as defined above.

According to a sixth aspect of the present invention there is provided an internal combustion engine having a turbocharger as defined above.

BRIEF DESCRIPTION OF THE FIGURES

Specific embodiments of the invention will now be described, by way of example only, with reference to the accompanying drawings, in which.

DETAILED DESCRIPTION

Figure 1:
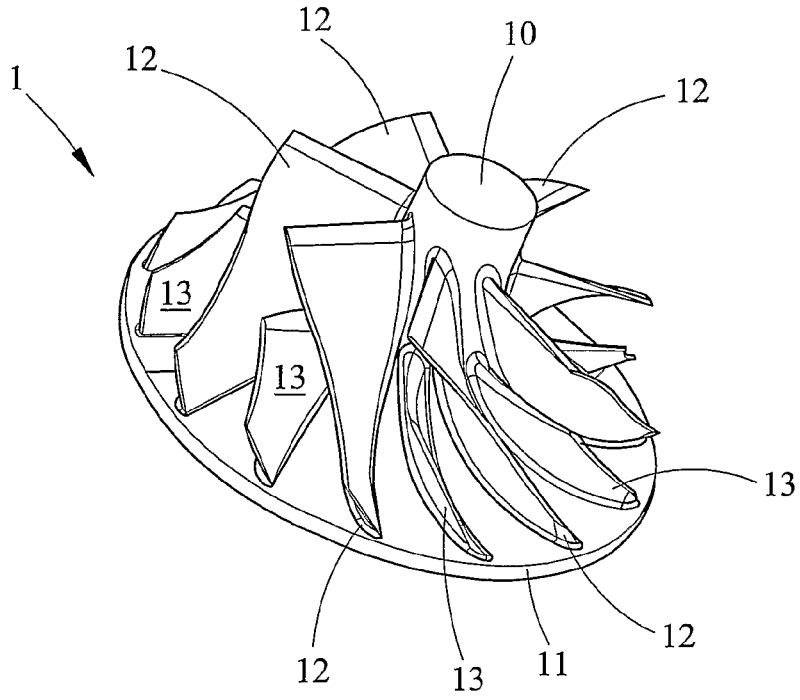
FIG. 1 is a perspective view of a compressor impeller wheel for a turbocharger that can be manufactured in accordance with the present invention.
Figure 2:
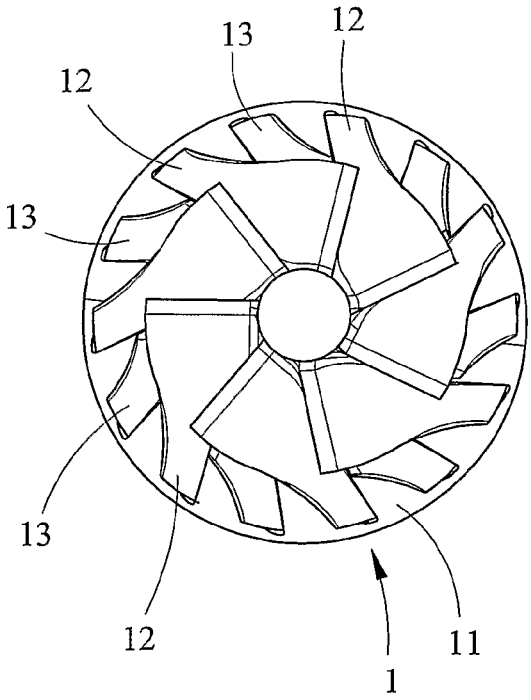
FIG. 2 is a front view of the impeller wheel of FIG. 1.
Figure 3:
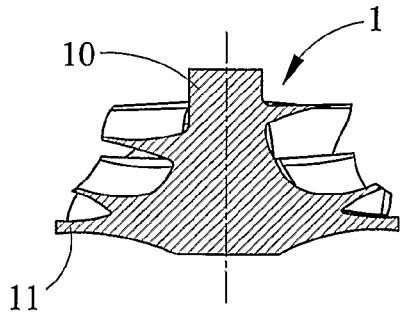
FIG. 3 is a sectioned side view of the impeller wheel of FIG. 1.

Referring now to FIGS. 1 to 3 of the drawings, a compressor wheel 1 comprises a central, generally cylindrical hub 10 that flares radially outwardly to a base part 11. The hub 10 defines a central axis about which the wheel rotates in use and supports a plurality of circumferentially spaced, thin-walled blades of around 1 mm thickness that extend outwardly of the axis. The blades subtend an angle of typically between 45° and 90° at the hub and are of two types that are arranged alternately around the hub: main blades 12 and shorter splitter blades 13. It will be evident from the figures that the blades 12, 13 have a complex twisted profile to direct the air in the desired manner and feature tapers, undercuts and other sudden changes in surface contours.

The material used to manufacture the compressor wheel of the present invention is an aluminium alloy. An example of the alloying element combination is silicon, copper and magnesium. The pre-cast material is thixotropic at semi-solid state i.e. its microstructure comprises approximately spheroid degenerated dendritic aluminium particles surrounded by aluminium-alloying element eutectics, such as that described in detail in U.S. Pat. No. 5,879,478. An example is described below.

Figure 4:
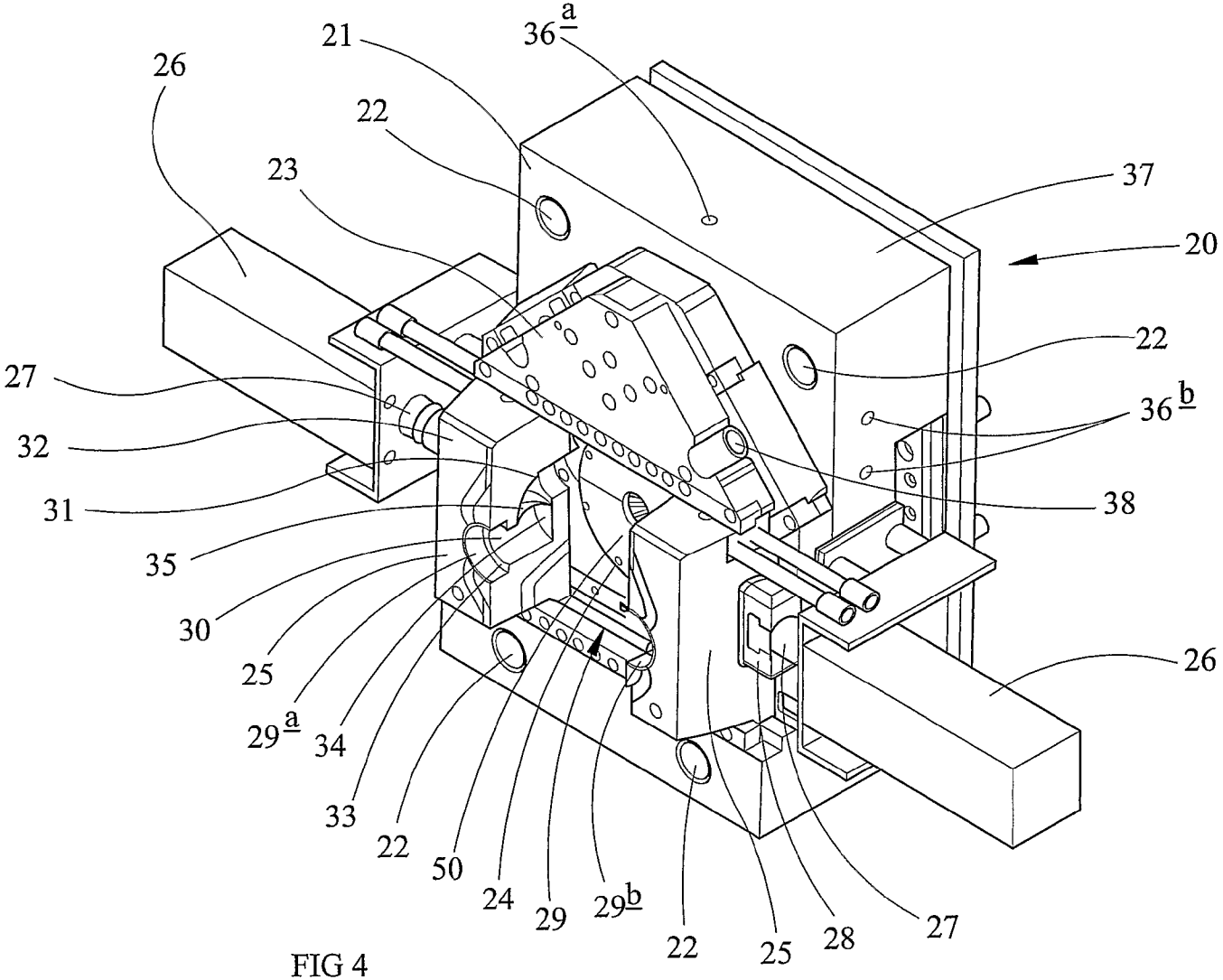
FIG. 4 is a perspective view from the front of a first part of one embodiment of a die assembly of the present invention.

The compressor wheel is formed by using an injection machine with a piston drive to inject the semi-solid material into a specially designed die assembly that comprises three main parts: a first part 20 (FIG. 4), a second part 40 (FIG. 5) and a cartridge 50 (best seen in FIGS. 6 to 9) in which the product is formed. The first part of the die 20 is designed to receive the cartridge 50 (as illustrated in FIG. 4) and the first and second parts of the die 20, 40 are brought together before the forming process starts. The second part of die 40 is bolted to the outlet of the semi-solid material injection machine for the forming process and is thus fixed whereas the first part 20 is movable relative thereto so that it can be disconnected to enable the cartridge 50 to be removed from the die assembly.

Figure 5:
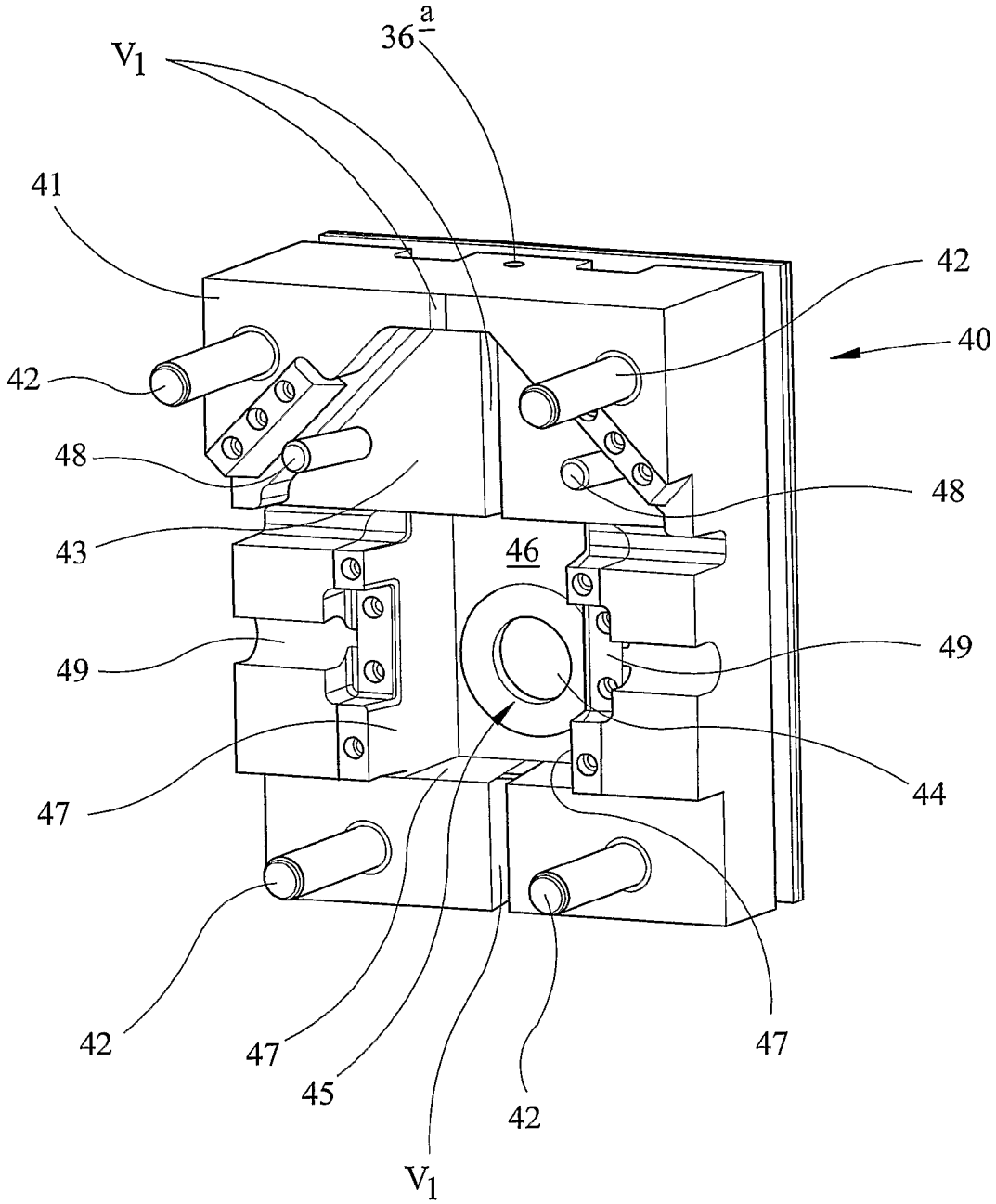
FIG. 5 is a perspective view from the rear of a second part of the die assembly of the present invention for connection to the moving part of the die depicted in FIG. 4.

As can be seen in FIGS. 4 and 5, the die parts 20, 40 are approximately square in profile and have a number of complementary mating elements. Each die part has a main body that defines a mating surface 21, 41 for abutment with the corresponding mating surface on the other part. The mating face 21 of the first part 20 of the die has four bores 22, one towards each corner, that receive corresponding guide pins 42 projecting from the second part 40 of the die and has an approximately frusto-wedge shaped projecting portion 23 that is received in a corresponding recess 43 in the second part of the die. The main body of the first die part defines a central cylindrical chamber 24 for receipt of the cartridge 50 and this is closable by a pair of runner blocks 25 that are each slidably mounted on the main body. Each runner block 25 is substantially rectangular in section and is slidable relative to the main body by actuation of a respective hydraulic cylinder 26 that is fixed to the flank of the main body of the first die part 20. The rod 27 of the cylinder 26 is secured to the flank of the runner block 25 in each case by an end connector 28. The blocks 25 are shown in FIG. 4 as part way between open and closed positions and the hence cartridge 50 is partially obscured.

Figure 17:
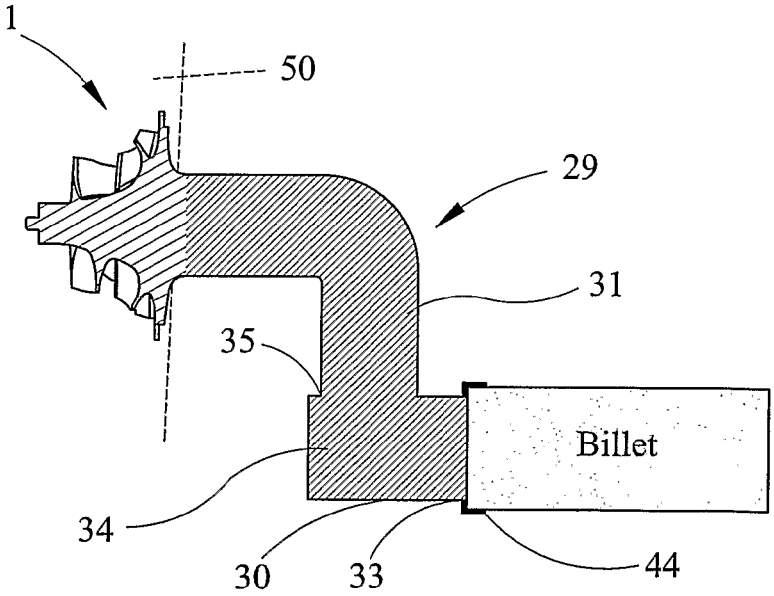
FIG. 17 is a schematic representation illustrating the flow of material through the die of the present invention

The runner blocks 25 each have semi-cylindrical recesses 29*a,b* that combine to define a runner passage 29 when the blocks 25 are brought together to close the chamber 24. This runner passage 29 is brought into register with a circular opening 44 in the second part of the die 40 when the two parts 20, 40 of the die are brought together and serves to provide communication between the cartridge 50 and the injection moulding machine (not shown). As will be seen in FIGS. 4 and 17, the runner passage 29 is configured in such a way that it can be divided into two portions: a first substantially cylindrical straight portion 30 and a second curved portion 31. The first portion 30 extends from a front face 32 of the runner blocks 25 has a radially inward step 33, has a blind end face 34 and a side opening 35 adjacent to, but spaced from, the end face 34. The volume of the passage defined between the opening 35 and the end face 34 serves as an oxide trap as will be described below. The second portion 31 extends from a position adjacent to the chamber 24 towards the front face 32 in a direction that is initially parallel to, but laterally offset from, the first portion 30. It then changes direction through 90 degrees to connect with the side opening 35 in the first portion 30.

The runner blocks 25 act as a support for the cartridge 50 and help to contain the effect of the high pressures to which the semi-solid material is subjected in the cartridge. They also define the runner passage 29 for the semi-solid material as it passes from the shot sleeve of the injection machine (not shown) into the cartridge 50.

The main bodies of the respective parts of the die 20, 40 are penetrated by a plurality of small bore passages 36*a* that serve as oil galleries and, in use, are filled with oil delivered from an external oil heater (not shown). The oil in these passages 36*a* is designed to regulate the temperature of the die and therefore the cartridge 50. Additional internal electrical resistance heaters (hidden from view in the figures) are provided in bores 36*b* in the main body 37 of the first part 20 of the die.

Turning now to the second part of the die, as shown in FIG. 5 the main body has a central rectangular recess 45 that is designed to receive the runner blocks 25 when they are in the closed position. The recess is defined by a front wall 46 and four side walls 47. The central opening 44 that is designed to register with the runner passage 29 is defined in the front wall 46 of the recess 45. Immediately above the main central recess there is an approximately trapezoidal recess 43 that is complementary to the corresponding frusto-wedge projection 23 on the first part of the die 20. The recess 43 has a pair of projecting pins 48, slightly smaller than those, 42, mounted at the corners, that are designed fit in corresponding bores 38 in the first part of the die 20. Additional recesses 49 are provided to accommodate the rods 27 and end connectors 28 of the hydraulic cylinders 26. Venting channels $V_1$ are defined in the mating surface 41 of the second part of the die.

In operation, the cartridge 50 is inserted into the chamber 24 of the first part of the die 20 and the hydraulic cylinders 26 are actuated to close the runner blocks 25. The first and second parts of the die 20, 40 are then brought into register by aligning the pins 42 on the second part with the corresponding bores 22 on the first part 20 and then bringing the parts together. The semi-solid billet (shown schematically in FIG. 17) is then injected from the shot sleeve of the injection machine through the opening 44 in the second part of the die 40 and into the runner passage 29. The opening 44 in the die is of a smaller diameter than the outlet of the shot sleeve and the edge of the wall that defines it thus serves to strip oxides from the surface of the semi-solid aluminium billet that have formed as a result of contact with air. The step 33 in the runner passage 29 similarly serves to strip the surface layers from the billet as it passes therethrough. This allows only material from the core of the billet to proceed into the cartridge 50. The leading end of the billet, which also contains oxides, is similarly stripped by virtue of it being directed into the oxide trap in front of the end face 34 of the first portion 30 of the runner passage 29. The stripped billet then passes through the side opening 35 into the second portion 31 of the runner passage 29 and into the cartridge 50.

Figure 6:
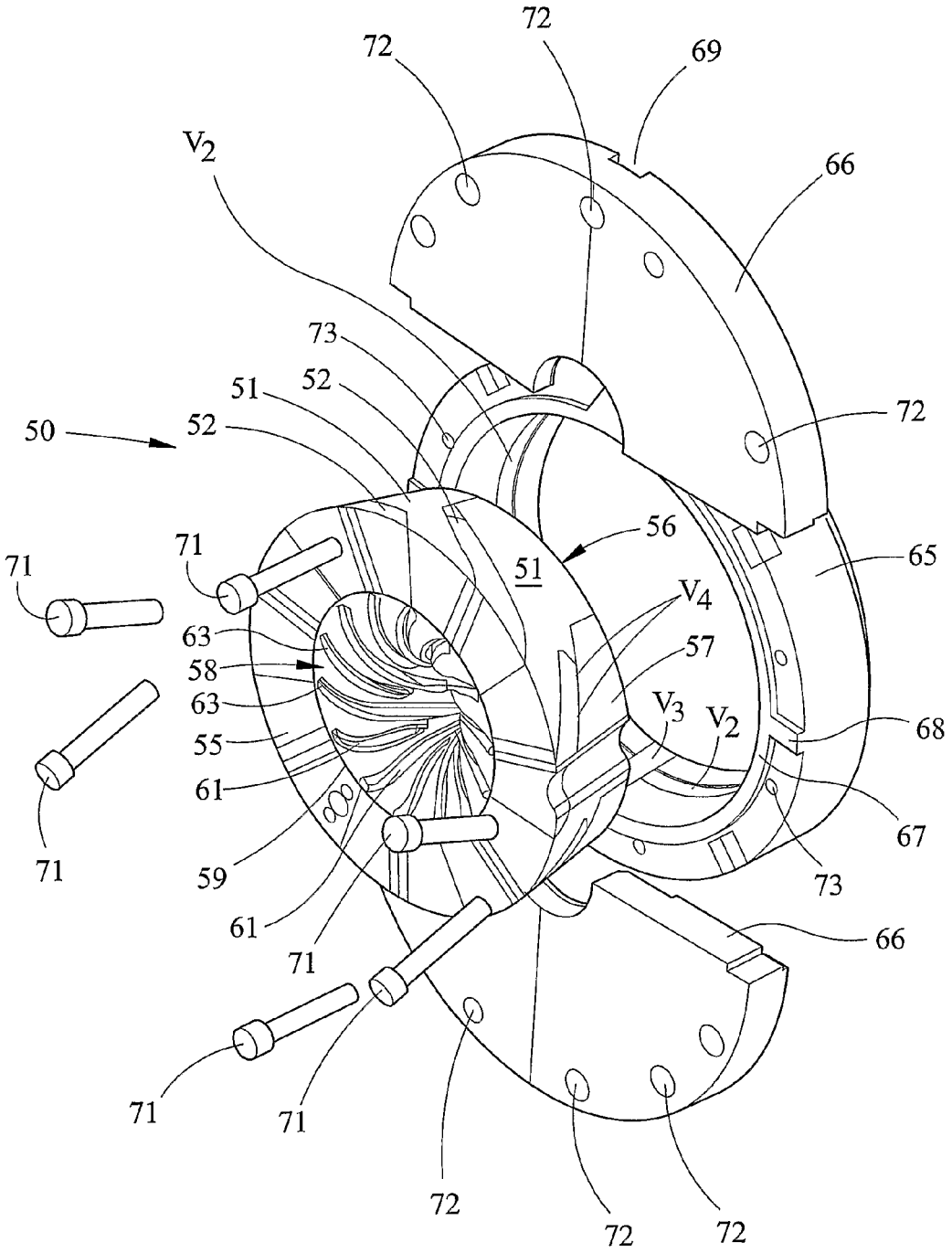
FIG. 6 is an exploded perspective view from the front of the cartridge forming part of the die assembly of the present invention.
Figure 8:
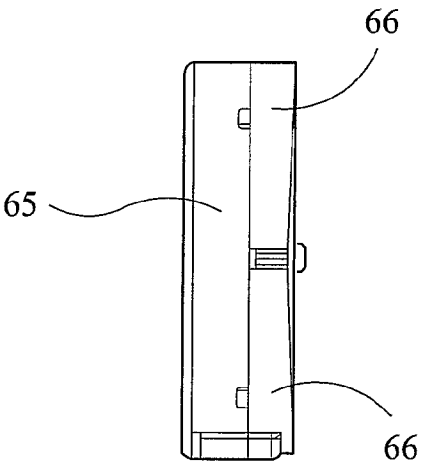
FIG. 8 is a side view of the assembled cartridge of FIG. 7.
Figure 7:
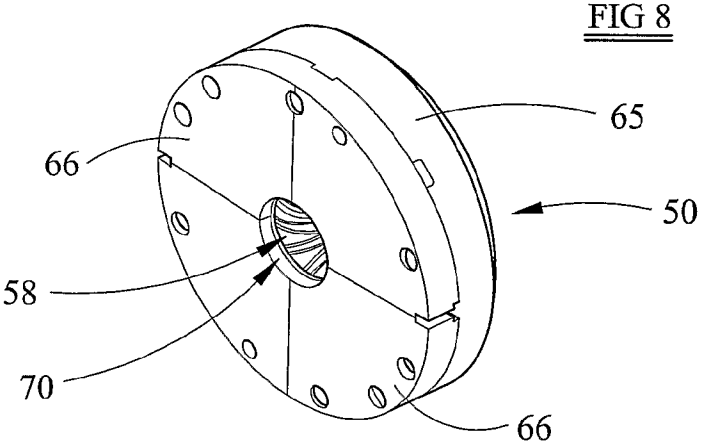
FIG. 7 is a front perspective view of the cartridge of FIG. 6 shown in assembled form.
Figure 9:
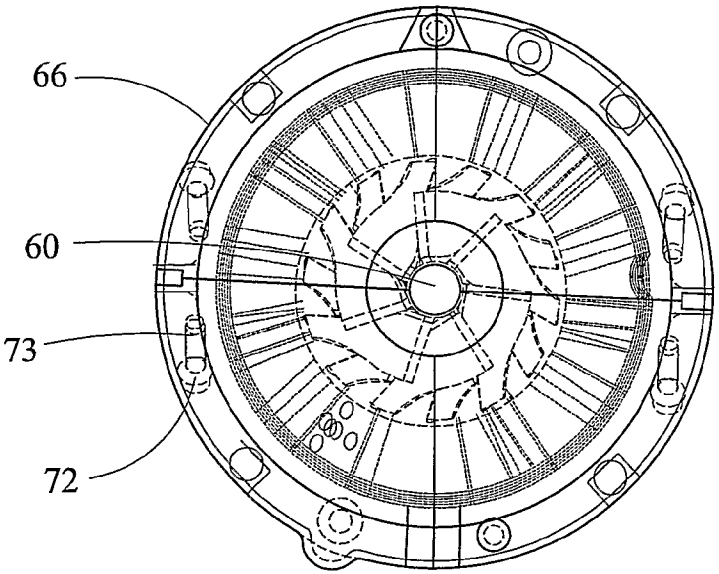
FIG. 9 is a front view of the assembled cartridge of FIG. 7, with hidden features shown in dotted line.

The cartridge 50, illustrated in detail in FIGS. 6 to 8, comprises a plurality of major and minor cartridge segments 51, 52 that are arranged alternately in an annulus and assembled to define planar front and rear walls 55, 56 and an annular side wall 57. The segments 51, 52 combine to define a radially outer portion that is substantially solid with a substantially constant depth in the axial direction and an inner portion that increases in depth from the front to the rear in the axial direction to define a central hub cavity 58. In the outer portion the facing surfaces of the die segments 51, 52 mate and are in engagement, whereas the inner portion provides the cavities for producing the blades of the wheel. The hub cavity extends from a large circular opening 59 in the front wall 55 to a relatively small circular opening 60 in the rear wall 56 of the cartridge 50, and a plurality of thin twisted passages 61 extend outwardly from the cavity 58 towards the outer portion and across a significant portion of the distance between the front and rear walls 55, 56. The central cavity 58 is generally cylindrical in section and tapers inwardly with a curved progression from the front to the rear walls 55, 56. The shape of the cavity 58 serves to define the hub 10 of the finished wheel. The twisted passages 61 are defined between mating surfaces of the segments 51, 52 and are each open to the cavity by means of elongated slots 63. It will be appreciated that the profile of these passages 61 is designed to define the shape of the blades 12, 13 of the wheel. The cartridge segments 51, 52 are described in more detail below.

The inner cartridge body 50, once assembled, is retained inside an annular outer cartridge ring 65 covered by a pair of locking cover plates 66. In view of this, the outer ring 65 has an inside diameter that is substantially identical to, or slightly greater than, the outside diameter of the inner cartridge body so as to be a close fit. When the cartridge body 50 is received in the outer ring 65, the cover plates 66 are placed over the front wall thereof 55 and are secured in place. Relative rotation of the cover plates 66 and the cartridge ring 65 is prevented by interlocking mating elements. In particular, an annular lip 67 and radial spokes 68 are defined on the front surface of the ring 65 and are designed to mate with complementary recesses 69 (only one sort is shown in the figures, the other sort being hidden) defined on the underside of the cover plates. The plates 66 combine to cover the front wall 55 and part of the cavity 58 of the inner cartridge body 51, 52 but define a central opening 70 for communication with the outlet of the runner passage 29 and the cavity 58. Once assembled the various parts of the cartridge 50 are rigidly secured together by a plurality of screws 71 that pass through apertures 72 in the locking cover plates 66 and into threaded apertures 73 in the outer ring 65. The screws 71 and corresponding apertures 72, 73 are inclined with respect to the central axis of the cartridge 50 as can be seen from FIG. 9.

An annular venting channel $V_2$ is defined on the inside of the outer ring 65 and is intersected by several axially extending venting channels $V_3$ (one only shown in FIG. 6). These channels $V_2$, $V_3$ provide communication between the venting channels $V_1$ in the die part 40 and vents $V_4$ (two shown in FIG. 6) defined in outer part of the mating surfaces of the die segments 51, 52.

Figure 12:
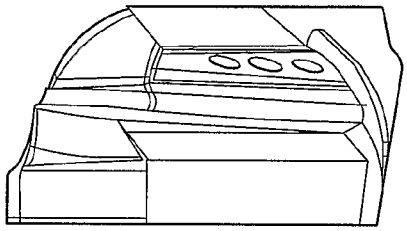
FIG. 12 is a side view of the die segment of FIG. 10 in the direction of arrow X.
Figure 10:
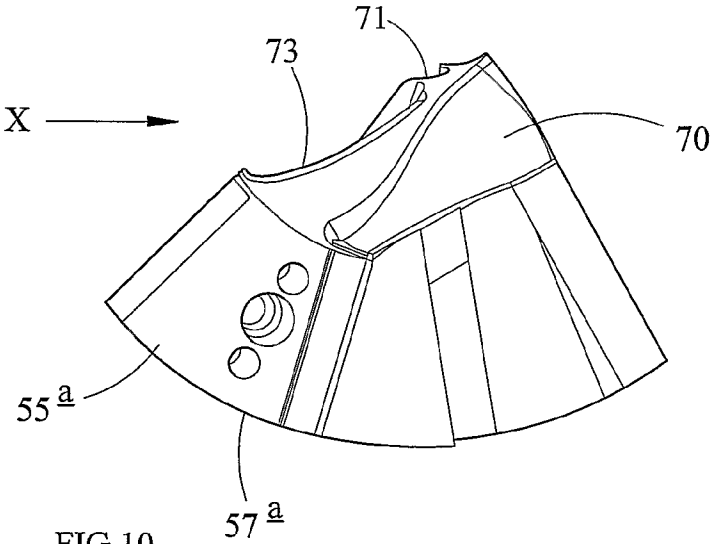
FIG. 10 is a front view of a major die segment of the cartridge assembly of FIGS. 6 to 9.
Figure 11:
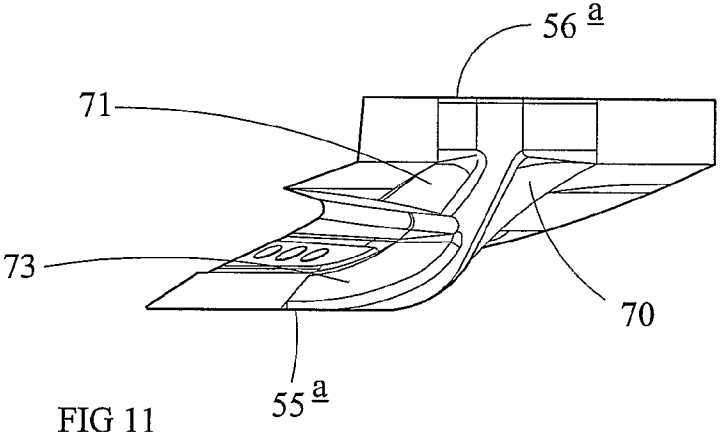
FIG. 11 is a plan view of the die segment of FIG. 10 in the direction of arrow W.
Figure 15:
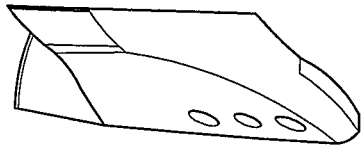
FIG. 15 is a side view of the die segment of FIG. 13 in the direction of arrow Z.
Figure 13:
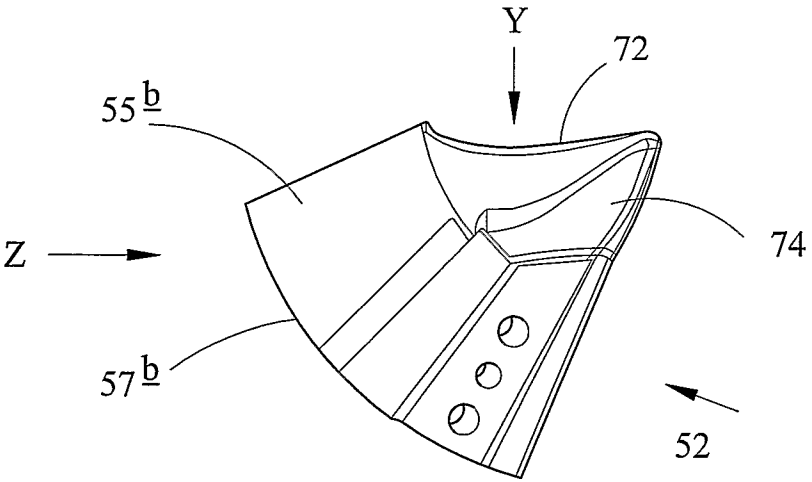
FIG. 13 is a front view of a minor die segment of the cartridge assembly of FIGS. 6 to 9.
Figure 14:
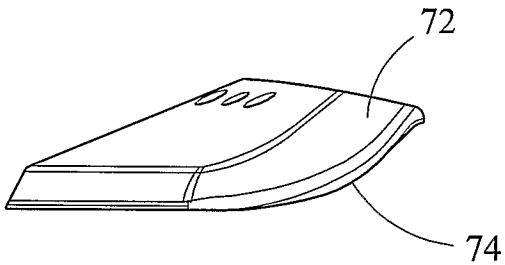
FIG. 14 is a plan view of the die segment of FIG. 13 in the direction of arrow Y.

Each major segment 51 of the cartridge body, illustrated in FIGS. 10 to 12 is identical and extends from the front to the rear of the cartridge assembly 50 with planar front and rear walls 55*a*, 56*a* and an outer circumferential side wall 57*a*. Each minor segment 52, illustrated in FIGS. 13 to 15, is received between adjacent major segments 51 but does not extend all the way to the rear wall 56 of the cartridge assembly 50. It has a planar front wall 55*b* with an outer circumferential side wall 57*b*. In the outer portion of the cartridge, the mating surfaces of the segments 51, 52 abut and interlock, whereas in the inner region the mating surfaces are recessed in places to define the passages 61 used to form the main and splitter blades 12, 13 of the wheel. The passage that defines a major blade cavity is defined towards the front of the cartridge assembly 50 between the adjacent mating surfaces 70, 72 of the major and minor segments 51, 52 respectively and at the rear between mating surfaces 70, 71 of adjacent major segments 51. The passage that defines the minor blade cavity is defined between the adjacent mating surfaces 73 and 74 of the major and minor segments respectively. The vents $V_4$ defined between the major and minor segments emerge from the blade cavities and provide communication therewith The cartridge segments 51, 52 are made from a combination of tool steels. Any part of the tooling that comes into contact with the semi-solid Aluminium is made from H13 Premium, tool steel in a known process. This material has properties suitable for hot work being hard wearing to cope with the thermal cycles involved in the semi solid process, dimensionally accurate, stable and able to be polished to a high surface finish. Once the tooling has had all its cutting work finished the parts are given a surface nitride hardening. This is to improve tool life and to aid the disassembly of the individual parts after forging.

The first and second parts 20, 40 of the die are made from AISI P20. A mid-carbon (C 0.33%), mild alloy (Cr 1.6%, Mo 0.5%) grade that is suitable for a wide range of moulding applications. Used pre-hardened to 269-302 Brinell (28-32 Rockwell C).

In use, the assembled cartridge unit 50 is placed into the first part of the die 20 (as shown in FIG. 4) using a manipulator (robot) arm (not shown). The die 20 is heated by means of the oil and the cartridge heaters so that the cartridge is at a temperature of 260° when the forming process starts and are maintained within a temperature band during the forming process. During the forming process, the vents $V_4$ allow the egress of air from the die cavities as the semi-solid material is introduced. The air is expelled from the die cavities to atmosphere via, in sequence, the venting channels $V_2$, $V_3$ in the outer ring of the cartridge and then the venting channels $V_1$ in the outer die part 41. After the forming process, the die parts are separated and the runner block moved to the open configuration to allow removal of the cartridge assembly. After suitable cooling time the cartridge is disassembled by unfastening and removing the cover, sliding the inner cartridge body 50 out of the outer ring and sliding the major and minor segments in a generally radially outwards direction to reveal the formed wheel. The disassembly can be performed by robot manipulators. It will be appreciated that one of the principal benefits of the cartridge design is that the segments can be released easily from the assembly cartridge body by moving them along a predetermined path that can be traversed by a robot manipulator operated under the control of software that is programmed with the appropriate spatial co-ordinates. The segments of the cartridge can thus be reused.

Figure 16:
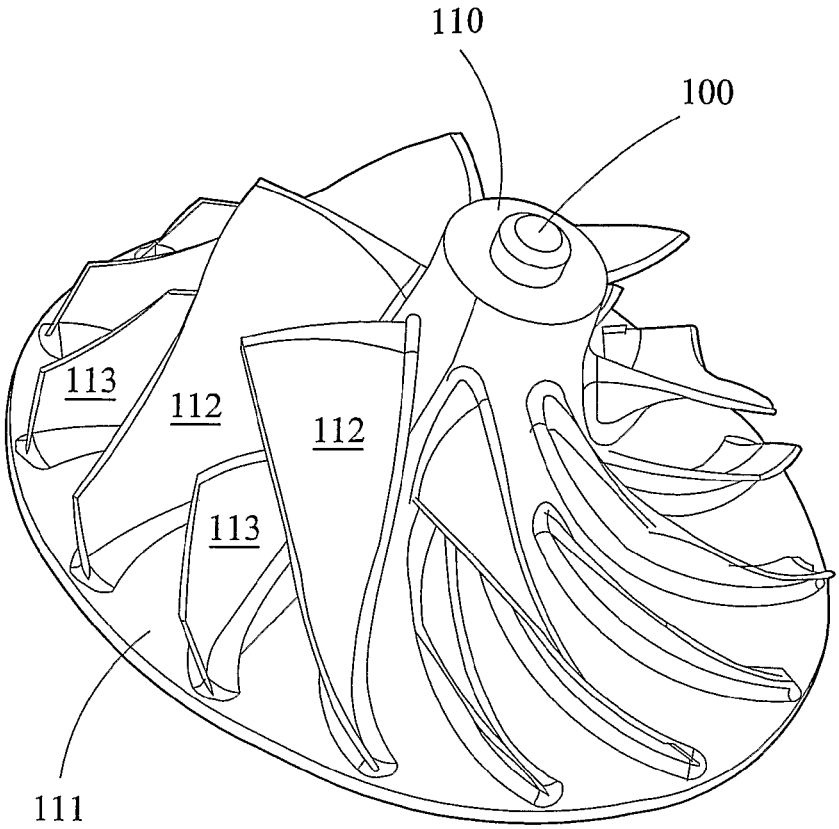
FIG. 16 is a perspective view of a compressor wheel immediately after having been removed from the die cartridge assembly of FIGS. 6 to 9.

An example of a compressor wheel formed with the die cartridge assembly shown in FIGS. 6 to 15 is depicted in FIG. 16. Parts that correspond to those of FIGS. 1 to 3 are indicated by the same reference numerals increased by 100 and are not further described. It will be seen that the small diameter end of the hub 110 has a projecting nipple 100 formed by material passing through the opening 60 in the rear wall of the cartridge 50. This nipple 100 may contain oxides and is removed by machining.

EXAMPLE

A compressor wheel with outside diameter of 98 mm has been successfully demonstrated by thixocasting an aluminium-silicon-copper-magnesium alloy. Chemical composition (weight percentage) of the alloy is given as below, Copper: 2.5-3.5%
Silicon: 5.5-6.5%
Magnesium: 0.3-0.4%
Strontium: 0.01-0.05%
Others each: <0.03%
Other total: <0.1%

The pre-cast raw material has a thixotropic semi-solid microstructure, i.e. globular degenerated dendritic aluminium particles surrounded by silicon and copper eutectics as described, for example, U.S. Pat. No. 5,879,478. The microstructure was modified by electromagnetic agitating. The solid billets produced were 90 mm in diameter and 2 m in length and were cut into blanks of length 178 mm. The blanks were reheated to the semi-solid state by induction heating to a temperature in the range of 572° C. to 589° C., where blanks contain about 40-60% solid phase material to give the best material quality in the finished components. The heated blanks were transferred into a die injection machine and then injected within 10 seconds into the die specially designed as described above. A hot cartridge with a temperature of between 200° C. and 350° C., depending on the required surface quality of the finished component, in combination with a high pressure in range of 750 and 1050 bar, depending on requirement of shrinkage porosity limitation, was used to manufacture a compressor wheel in accordance with the present invention.

The compressor wheels manufactured as described above have been tested in two specially designed rig testing facilities. One, which measures the aerodynamic performance, has shown that the semi-solid processed wheel has the same aerodynamic performance as a wheel machined from a forging or cast from liquid metal. A second test rig, which simulates the actual cyclic operating conditions found in a diesel engine application, and therefore measures the durability of the wheels, has shown significantly longer durability than a cast wheel and durability comparable with a component machined from a forging.

It is to be understood that the method of the present invention can be performed using a thixoforming technique such as thixocasting whereby the semi-solid material is produced by re-melting solid billets of modified degenerate dendritic microstructure and forming the material in the semi-solid state in a mould by casting, forging or the like. Alternatively it may be performed using a rheoforming technique, such as rheocasting, whereby the semi-solid material is produced "on-demand" by cooling it to the semi-solid state that is immediately formed in the mould.

It is also to be appreciated that the die assembly and method of the present invention could be used to form the blades of a wheel on to a pre-formed hub. In such a method the hub is manufactured by conventional methods such as, for example, casting, forging or machining and is then inserted into the die cavity and the semi-solid material from a suitable opening in the cartridge. In this technique the blades are formed to be integral with the hub.

In one form of the present application is provided a method for forming a turbine or compressor wheel, the wheel having a hub and a plurality of blades of complex curvature extending outwardly from the hub, using a die assembly comprising an outer die and an inner die cartridge assembly, the method comprising assembling the inner die cartridge assembly from a plurality of die segments so that the cartridge assembly defines a central hub cavity and a plurality of blade cavities extending outwardly from the hub cavity, said blade cavities being defined between adjacent die segments, inserting the cartridge assembly into the outer die, injecting a semi-solid metal alloy into the die so that it flows into the cartridge assembly and the blade cavities, maintaining temperature and pressure within the cartridge assembly within predetermined ranges during the injection stage, removing the cartridge assembly from the outer die and separating the die segments of the cartridge assembly to release the formed wheel;

wherein the alloy is injected within 10 seconds;
wherein the alloy is injected within 5 seconds;
wherein the alloy is injected within 2 seconds.

The invention claimed is:

1. A method for forming a turbine or compressor wheel, the wheel having a hub and a plurality of blades of complex curvature extending outwardly from the hub, using a die assembly comprising an outer die and an inner die cartridge assembly, the method comprising the steps of assembling the inner die cartridge assembly from a plurality of die segments so that the inner die cartridge assembly defines and substantially encloses a central hub cavity and a plurality of blade cavities extending outwardly from the hub cavity, said blade cavities being defined between adjacent die segments, inserting the inner die cartridge assembly into the outer die, injecting a semi-solid metal alloy into the die assembly so that it flows into the cartridge assembly and blade cavities, maintaining temperature and pressure within the inner die cartridge assembly within predetermined ranges during the injection stage, removing the inner die cartridge assembly from the outer die and separating the die segments of the inner die cartridge assembly to release the formed wheel, wherein the alloy is injected via a runner passage in a runner block mounted on the outer die, the runner passage providing communication between an injection device and the central hub cavity, the runner block being moved to a first position after insertion of the inner die cartridge assembly so that it is positioned over the inner die cartridge assembly and secured to the outer die to support the inner die cartridge assembly and contain the effect of the pressure to which the semi-solid metal alloy is subjected in the inner die cartridge assembly and the runner block is moved to a second position in which it is clear of the inner die cartridge assembly after the injection step is complete so as to allow removal of the inner die cartridge assembly.

2. A method according to claim 1, wherein the die segments are assembled to define a cartridge assembly that is substantially annular.

3. A method according to claim 1, wherein:

the cartridge assembly further comprises an outer ring having a central opening; and assembling the inner die cartridge further comprises placing the segments inside the central opening of the outer ring of the cartridge assembly.

4. A method according claim 3, wherein the alloy is injected through an opening in the cartridge assembly into the hub cavity.

5. A method according to claim 1 wherein the cartridge assembly further comprises a cover, the hub cavity being defined between an outer surface of the die segments and the cover.

6. A method according to claim 5, wherein the cover is assembled with the die segments before insertion of the cartridge assembly into the outer die.

7. A method according to claim 5, wherein the cover is secured to an outer cartridge ring.

8. A method according to claim 1, wherein the semi-solid material is injected such that it first enters the hub cavity and then progresses into the blade cavities.

9. A method according to claim 1 wherein the alloy passes from the hub cavity into the blade cavities via slot-like openings.

10. A method according to claim 1, wherein the inner die cartridge is reassembled for re-use after the formed wheel has been released.

11. A method according to claim 1, wherein the die cartridge assembly is pre-heated to a pre-determined temperature before injection.

12. A method according to claim 11, wherein the die cartridge assembly is preheated to a predetermined temperature prior to insertion into the outer die.

13. A method according to claim 1, wherein the semi-solid alloy is produced by thixoforming or rheoforming.

14. A method according to claim 1, wherein the cartridge assembly is cooled prior to separation of the die segments.

15. A method according to claim 1 wherein at least the die segments are treated with a release agent prior to injection.

16. A method according to claim 1, wherein after a predetermined period following injection of the alloy, the cartridge assembly is removed from the rest of the die assembly and the segments are separated to expose the blades of the wheel.

17. A method according to claim 1, wherein the die assembly further comprises first and second parts that define a chamber in which the cartridge assembly is received and the cartridge assembly is placed in the chamber and then first and second parts of the die are brought into sealing engagement.

18. A method according to claim 17, wherein the chamber is defined in the first part of the die assembly.

19. A method according to claim 17, further comprising the steps of using locating members defined on the die parts to align the first and second parts of the die when they are brought together.

20. A method according to claim 17, further comprising the step of introducing heated oil into bores in the die parts to maintain the temperature of the cartridge within a predetermined range.

21. A method according to claim 1, wherein the runner block has first and second portions that are brought together in the first position to define the runner passage and are moved apart to the second position.

22. A method according to claim 21, wherein the first and second portions are slid relative to the first part of the die by an actuator.

23. A method according to claim 21, wherein the first and second portions of the runner block are slidably mounted on the outer die.

24. A method according to claim 23, wherein the first and second portions of the runner block are slid relative to the outer die by an actuator fixed to the outer die.

25. A method according to claim 1, wherein a stepped reduction in size of the runner passage is used to strip oxides from an outer portion of the alloy.

26. A method according to claim 1, wherein the runner passage has a first portion that extends from an inlet to the runner block and a second portion that extends from adjacent to the die hub cavity, the first and second portions intersecting, the first portion having a blind end after the intersection, and the volume between the intersection and the blind end serving to receive an initial portion of the injected alloy so as to serve as an oxide trap.

27. A method according to claim 1, wherein the runner passage is brought into register with an inlet opening in the cartridge assembly when the runner block is in the first position.

28. A method according to claim 1, wherein the temperature is maintained in the range 0.6 (liquidus temperature) +/−90K.

29. A method according to claim 1, wherein the temperature is maintained in the range 200° C. to 350° C.

30. A method according to claim 1, wherein the pressure is maintained in the range 550 to 1050 bar.

31. A method according to claim 1, wherein the pressure is maintained in the range 550 to 2800 bar.

32. A method according to claim 1 wherein the alloy is injected in 40 to 60% solid phase.

33. A method according to claim 1, wherein the alloy is injected from a shot sleeve of an injection machine.

34. A method according to any preceding claim, wherein the alloy is injected within 10 seconds.

35. A method according to claim 34, wherein the alloy is injected within 5 seconds.

36. A method according to claim 35, wherein the alloy is injected within 2 seconds.

37. A method according to claim 1, wherein once injected into the inner die cartridge assembly the alloy is allowed to cool for a predetermined time such that it reaches substantially 100% solid phase before the cartridge is removed from the outer die.

38. A method according to claim 37, wherein the cartridge is cooled with the pressure of the alloy being maintained substantially constant.

39. A method according to claim 1, wherein the alloy is an aluminum alloy.

40. A method according to claim 39, wherein the alloy also comprises copper, silicon and magnesium.

41. A method according to claim 1, further comprising forming a blank of thixotropic semi-solid material, reheating the thixotropic material to a semi-solid state in order to achieve a predetermined viscosity suitable for forming and transferring the reheated blank to a die casting injection machine for forming the wheel.

42. A method according to claim 1, wherein the die cartridge assembly is made from a material that has a higher melting point than that of the wheel being formed.

43. A method according to claim 1, wherein the die segments are permanent die segments.

44. A method according to claim 1, wherein the semi-solid material deforms into the cavities under shear.

45. A method according to claim 1, wherein an outer layer is stripped from the semi-solid material before it enters the cartridge assembly.

46. A method according to claim 45, wherein the outer layer is stripped as it passes along a passage defined in the outer die.

47. A method according to claim 46, wherein said outer layer is stripped by a stepped reduction in the size of the passage.

48. A method according to claim 46, wherein said passage is defined in a runner block defined in a first part of the outer die, the passage providing communication between an injection device and the hub cavity.

49. A method according to claim 1, further comprising the step of allowing gas to egress from the hub and/or blade cavities as the alloy is introduced therein.

50. A method according to claim 49, wherein gas is permitted to egress though at least one vent in the die segments.

51. A method according to claim 50, wherein gas is permitted to egress further through at least one vent in the outer die.

52. A method according to claim 1, wherein assembling the inner die cartridge assembly further comprises assembling the inner die cartridge assembly from the die segments so that the cartridge assembly defines radially outward edges of the blade cavities that are radially inward of outer circumferential side walls of the die segments.

* * * * *

UNITED STATES PATENT AND TRADEMARK OFFICE

CERTIFICATE OF CORRECTION

PATENT NO. : 8,464,777 B2
APPLICATION NO. : 11/989271
DATED : June 18, 2013
INVENTOR(S) : Zhu et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 502 days.

Signed and Sealed this
Eighth Day of September, 2015

Michelle K. Lee

Michelle K. Lee
*Director of the United States Patent and Trademark Office*